US010772777B2

(12) United States Patent
Lyckestig et al.

(10) Patent No.: US 10,772,777 B2
(45) Date of Patent: Sep. 15, 2020

(54) LINKAGE ASSEMBLIES FOR PERSON LIFTING APPARATUSES

(71) Applicant: Liko Research & Development AB, Luleä (SE)

(72) Inventors: Johan Lyckestig, Luleä (SE); Karin L. Olsson, Södra Sunderbyn (SE); Ronnie Arespong, Boden (SE)

(73) Assignee: Liko Research & Development AB, Lulea (SE)

( * ) Notice: Subject to any disclaimer, the term of this patent is extended or adjusted under 35 U.S.C. 154(b) by 324 days.

(21) Appl. No.: 15/985,795

(22) Filed: May 22, 2018

(65) Prior Publication Data

US 2018/0344553 A1 Dec. 6, 2018

Related U.S. Application Data

(60) Provisional application No. 62/514,300, filed on Jun. 2, 2017.

(51) Int. Cl.
*A61G 7/10* (2006.01)

(52) U.S. Cl.
CPC ..... *A61G 7/1023* (2013.01); *A61G 7/1001* (2013.01); *A61G 7/1015* (2013.01); (Continued)

(58) Field of Classification Search
CPC .. A61G 7/1023; A61G 7/1001; A61G 7/1015; A61G 7/1061; A61G 7/1042; A61G 7/1051; F16B 19/02; F16B 19/16; Y10T 403/4614; Y10T 403/7182; Y10T 403/602; Y10T 403/604; Y10T 403/60
See application file for complete search history.

(56) References Cited

U.S. PATENT DOCUMENTS 3,335,468 A * 8/1967 Harley ..... F16G 17/00 24/115 R
2005/0011003 A1* 1/2005 Davis ..... A61G 7/1051 5/83.1

(Continued)

FOREIGN PATENT DOCUMENTS

WO WO2007035098 A2 * 3/2007 ..... A61G 7/1042 5/85.1

*Primary Examiner* — David R Hare
*Assistant Examiner* — Alexis Felix Lopez
(74) *Attorney, Agent, or Firm* — Dinsmore & Shohl LLP

(57) ABSTRACT

A linkage assembly that connects a sling bar to a person lift apparatus includes a link body that connects to the person lift apparatus. The link body has a keyed slot extending therethrough. The keyed slot has a region of reduced dimension. An interlocking member connects to the sling bar. The interlocking member has an interlocking portion that is sized to be slidably received in the keyed slot. The interlocking portion has a region of reduced dimension such that, in an interlocked orientation, the region of reduced dimension of the interlocking portion is offset from the region of reduced dimension of the keyed slot thereby inhibiting removal of the interlocking member from the keyed slot and, in a release orientation, the region of reduced dimension of the interlocking portion is aligned with the region of reduced dimension of the keyed slot thereby allowing removal of the interlocking member from the keyed slot to disconnect the sling bar from the person lift apparatus.

20 Claims, 9 Drawing Sheets

(52) U.S. Cl.
CPC ..... *A61G 7/1061* (2013.01); *A61G 7/1042* (2013.01); *A61G 7/1051* (2013.01)

(56) References Cited

U.S. PATENT DOCUMENTS

| | | | | |
|---|---|---|---|---|
| 2006/0253977 | A1* | 11/2006 | Hjort ..... | A61G 7/1042 5/85.1 |
| 2013/0086793 | A1* | 4/2013 | Faucher ..... | A61G 7/1061 29/525.01 |

* cited by examiner

LINKAGE ASSEMBLIES FOR PERSON LIFTING APPARATUSES

CROSS-REFERENCE TO RELATED APPLICATIONS

This application claims the benefit of priority to U.S. Provisional Application No. 62/514,300, titled "Linkage Assemblies for Person Lifting Apparatuses," filed Jun. 2, 2017, the details of which are incorporated herein by reference in their entirety.

BACKGROUND

Field

The present specification generally relates to person lifting apparatuses, and more particularly to person lifting apparatuses that include linkage assemblies for attaching sling bars to the person lifting apparatuses.

Technical Background

Person lifting apparatuses, such as mobile lifts and/or overhead lifts, may be used in hospitals, other health care facilities, and sometimes in home care settings to move a subject or assist in moving a subject from one location to another. Conventional person lifting apparatuses are coupled to a subject support apparatus that supports and engages the subject. The subject support apparatus may be connected to the person lifting apparatuses using a sling bar, as an example. The sling bar can include a connector that is used to releasably engage the person lifting apparatuses. Coupling the sling bar to and releasing the sling bar from the person lifting apparatuses can consist of a relatively simple unlatching process, not requiring much attention during the coupling and unlatching processes.

Accordingly, a need exists for alternative linkages between sling bars and person lifting apparatuses that require some amount of attention when coupling and decoupling the sling bars from the person support apparatuses.

SUMMARY

In one embodiment, a linkage assembly that connects a sling bar to a person lift apparatus includes a link body that connects to the person lift apparatus. The link body has a keyed slot extending therethrough. The keyed slot has a region of reduced dimension. An interlocking member that connects to the sling bar. The interlocking member has an interlocking portion that is sized to be slidably received in the keyed slot. The interlocking portion has a region of reduced dimension such that, in an interlocked orientation, the region of reduced dimension of the interlocking portion is offset from the region of reduced dimension of the keyed slot thereby inhibiting removal of the interlocking member from the keyed slot and, in a release orientation, the region of reduced dimension of the interlocking portion is aligned with the region of reduced dimension of the keyed slot thereby allowing removal of the interlocking member from the keyed slot to disconnect the sling bar from the person lift apparatus.

In another embodiment, a person lifting apparatus includes an overhead structure comprising a flexible member and a linkage assembly that is connected to the flexible member. The linkage assembly includes a link body that connects to the person lift apparatus. The link body has a keyed slot extending therethrough. The keyed slot has a region of reduced dimension. An interlocking member that connects to the sling bar. The interlocking member has an interlocking portion that is sized to be slidably received in the keyed slot. The interlocking portion has a region of reduced dimension such that, in an interlocked orientation, the region of reduced dimension of the interlocking portion is offset from the region of reduced dimension of the keyed slot thereby inhibiting removal of the interlocking member from the keyed slot and, in a release orientation, the region of reduced dimension of the interlocking portion is aligned with the region of reduced dimension of the keyed slot thereby allowing removal of the interlocking member from the keyed slot to disconnect the sling bar from the person lift apparatus.

In another embodiment, a method of coupling a sling bar to a person lift apparatus using a linkage assembly is provided. The method includes connecting a link body of the linkage assembly to the person lifting apparatus. The link body has a keyed slot extending therethrough. The keyed slot has a region of reduced dimension. An interlocking member is connected to the sling bar the interlocking member having an interlocking portion sized to be slidably received in the keyed slot. The interlocking portion has a region of reduced dimension such that, in an interlocked orientation, the region of reduced dimension of the interlocking portion is offset from the region of reduced dimension of the keyed slot thereby inhibiting removal of the interlocking member from the keyed slot and, in a release orientation, the region of reduced dimension of the interlocking portion is aligned with the region of reduced dimension of the keyed slot thereby allowing removal of the interlocking member from the keyed slot to disconnect the sling bar from the person lift apparatus. The interlocking member is positioned in the release orientation and the interlocking member is inserted into the keyed slot.

Additional features of subject support apparatuses described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
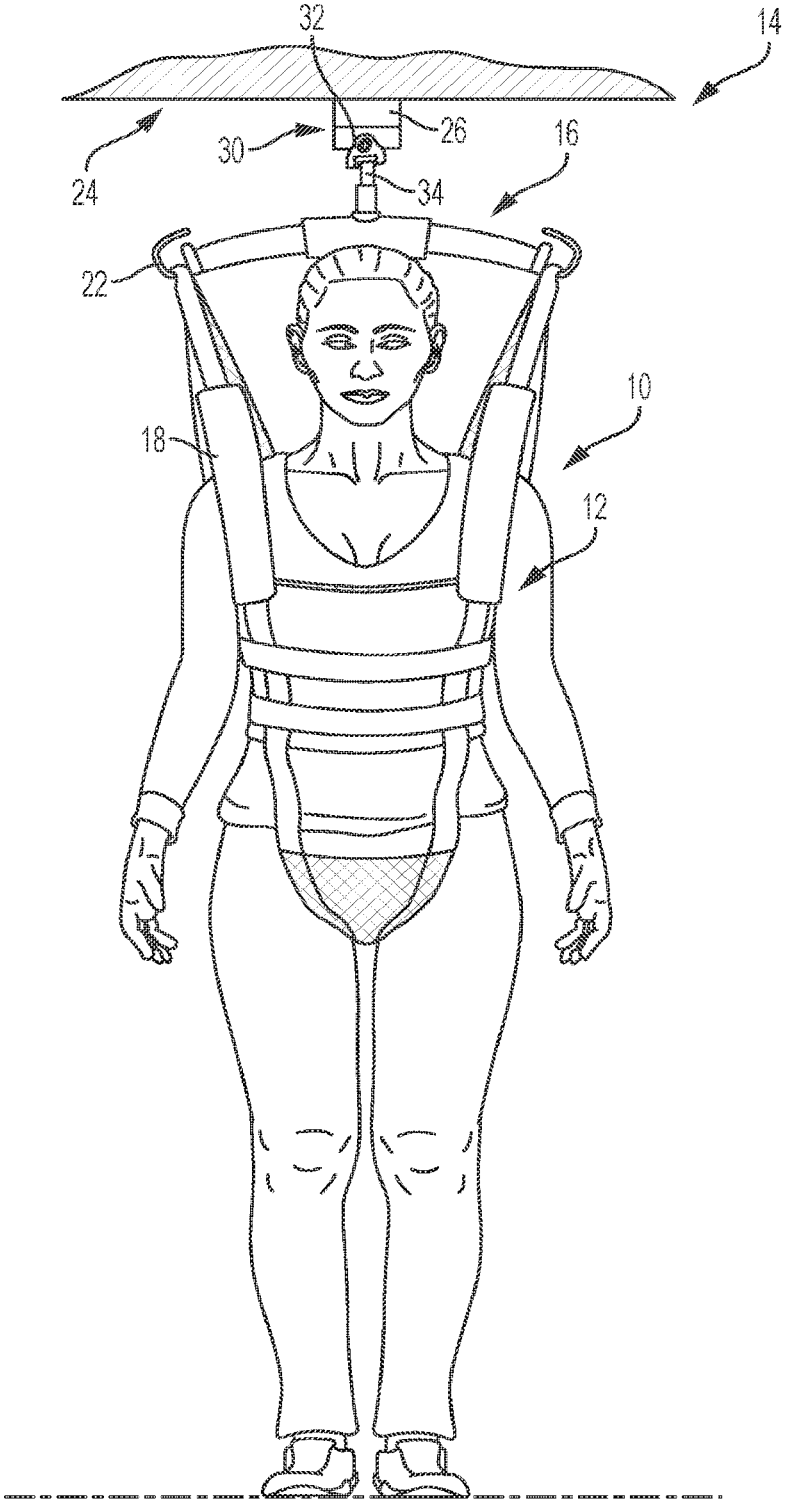
FIG. 1 illustrates a front view of a person lift apparatus with a linkage assembly that releasably connects a sling bar to the person lift apparatus according to one or more embodiments shown and described herein.

Reference will now be made in detail to embodiments of person lifting apparatuses and linkage assemblies for use therewith, examples of which are illustrated in the accompanying drawings. Whenever possible, the same reference numerals will be used throughout the drawings to refer to the same or like parts. The linkage assemblies are provided as multi-part linkage assemblies including a link body that connects to the person lifting apparatus. The linkage assemblies further include an interlocking member that connects to a sling bar. The link body includes a keyed slot that is sized to receive an interlocking portion of the interlocking member for releasable coupling between the link body and the interlocking member. In particular, the keyed slot of the link body and the interlocking portion of the interlocking member are shaped and configured such that the interlocking member has an interlocked orientation relative to the link body that inhibits removal of the interlocking member from the keyed slot and a release orientation relative to the link body that allows removal of the interlocking member from the keyed slot. Various embodiments of person lifting apparatuses and linkage assemblies will be described herein with specific reference to the appended drawings.

Referring to FIG. 1, a person 10 is illustrated in a subject support apparatus 12, which, in turn, is supported by a person lift apparatus 14. The subject support apparatus 12 is coupled to a sling bar 16 by looping shoulder straps 18 over hooks 22 of the sling bar 16. The subject support apparatus 12 is coupled to the sling bar 16 such that the subject support apparatus 12 may be removable from the sling bar 16, and different subject support apparatuses may be coupled to the sling bar 16.

The sling bar 16 may be coupled to an overhead structure 24, such as a ceiling and/or overhead beam. In some embodiments, the overhead structure may be part of the person lifting apparatus, such as a mobile lift. The sling bar 16 is releasably connected to a support strap 26 of the person lift apparatus 14 by a linkage assembly 30. The linkage assembly 30 includes a link body 32 that connects to the support strap 26 and an interlocking member 34 that connects to the sling bar 16. As will be described in greater detail below, the interlocking member 34 has an interlocked orientation relative to the link body 32 that inhibits removal of the interlocking member 34 from the link body 32 and a release orientation relative to the link body 32 that allows removal of the interlocking member 34 from the link body 32.

The subject support apparatus 12 is coupled to the sling bar 16 such that some or all of the bodyweight of the person 10 may be supported by the overhead structure 24. This support of the overhead structure 24 can assist the person 10 in a variety of activities, such as standing, walking, sitting, laying, etc. For example, in some instances, the sling bar 16 and the overhead structure 24 may be located above a treadmill and the overhead structure 24 may support some or all of the bodyweight of the person 10 to assist the person 10 in walking on the treadmill.

Figure 2:
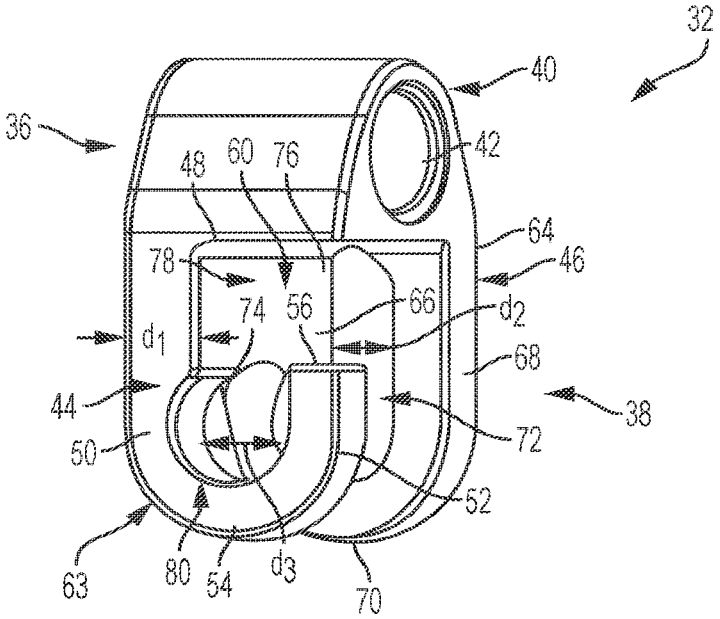
FIG. 2 illustrates a link body of the linkage assembly of FIG. 1 according to one or more embodiments shown and described herein.
Figure 3:
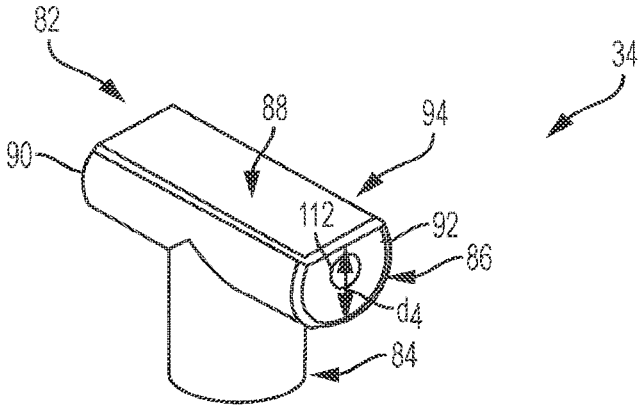
FIG. 3 illustrates an interlocking member of the linkage assembly of FIG. 1 according to one or more embodiments shown and described herein.

Referring to FIGS. 2 and 3 the link body 32 and the interlocking member 34, respectively, are illustrated in isolation. Referring first to FIG. 2, the link body 32 includes a lift connecting portion 36 and a sling bar connecting portion 38. The lift connecting portion 36 includes a connector 40, which, in this embodiment, is an opening 42 through the link body 32; however, any suitable connector 40 may be used, such as a buckle or other fastening structure. The sling bar connecting portion 38 includes a first connection leg 44 and a second connection leg 46 that is spaced-apart from the first connection leg 44. The first connection leg 44 extends downwardly from a first outer edge 48 of the lift connecting portion 36 and includes a first vertical portion 50 and a second vertical portion 52 that is connected to the first vertical portion 50 by a bend 54. The second vertical portion 52 terminates at an end 56 that is spaced vertically from the lift connecting portion 36 forming a hook shape 63 and providing a gap 60 between the end 56 and the lift connecting portion 36. As will be described below, the gap 60 is provided to allow the interlocking member 34 to be released from the link body 32.

The second connection leg 46 extends downwardly from a second outer edge 64 of the lift connecting portion 36 that is opposite the first outer edge 48 and includes a first vertical portion 66 and a second vertical portion 68 that is connected to the first vertical portion 66 by a bend 70. In the illustrated embodiment, both the first vertical portion 66 and the second vertical portion 68 of the second connection leg 46 are connected directly to the lift connecting portion 36. The first vertical portion 66 of the second connection leg 46 is spaced from the second vertical portion 68 forming a slot 72 therebetween. The slot 72 extends vertically from the bend 70 of the second connection leg 46 toward the lift connecting portion 36. The slot 72 is aligned with the hook shape 63 of the first connection leg 44 forming a keyed slot 74 therebetween.

The keyed slot 74 is provided by a vertical wall 76 that extends between the first connection leg 44 and the second connection leg 46. The vertical wall 76 has a widthwise dimension $d_1$. As will be described below, the thickness dimension $d_1$ of the vertical wall 76 provides the keyed slot 74 with a region 78 of reduced dimension $d_2$ in the widthwise direction compared to a region 80 of increased dimension $d_3$ below the vertical wall 76 where the interlocking member 34 (FIG. 3) can rest.

Referring to FIG. 3, the interlocking member 34 includes an interlocking portion 82 and a bar connecting portion 84 that extends outward from the interlocking portion 82. The interlocking portion 82 has a rounded portion 86 and a flat portion 88 that intersects opposite ends 90 and 92 of the interlocking portion 82 forming a truncated cylinder shape having a region 94 of reduced dimension $d_4$. While the portion 86 is illustrated as rounded, the portion 86 may be any suitable shape, such as polygonal. The bar connecting portion 84 extends outwardly from the interlocking portion 82 at a location between the ends 90 and 92 forming a T-shape. The bar connecting portion 84 extends outwardly from the interlocking portion 82 at a side of the interlocking portion 82 that is opposite the flat portion 88. Although not shown in FIG. 3, the bar connecting portion 84 may include any suitable connector for connecting to a sling bar.

Figure 4:
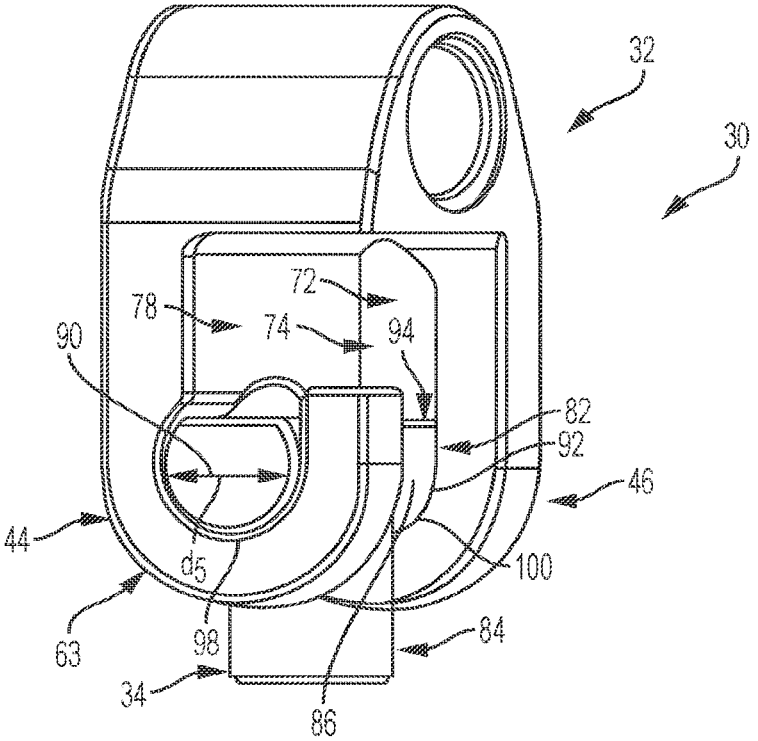
FIG. 4 is a perspective view of the interlocking member of FIG. 3 coupled with the link body of FIG. 2 forming the linkage assembly according to one or more embodiments shown and described herein.

Referring now to FIG. 4, the linkage assembly 30 is illustrated in an interlocked orientation with the region 94 of reduced dimension of the interlocking portion 82 angularly offset from the region 78 of reduced dimension of the keyed slot 74. In the interlocked configuration, the bar connecting portion 84 is located between the first connection leg 44 and the second connection leg 46, extending away from the lift connecting portion 36 of the link body 32 in order to be connected to a sling bar. The end 90 of the interlocking portion 82 is received within the hook shape 63 of the first connection leg 44 while the end 92 is received within the slot 72 of the second connection leg 46. A widthwise dimension $d_5$ parallel to the flat portion 88 is less than the dimension $d_3$ (FIG. 4) such that the rounded portion 86 rests against a rounded seating surface 98 of the hook shape 63. Likewise, the slot 72 of the second connection leg 46 may have a same dimension $d_3$, or even a different dimension, depending on the shape of the interlocking portion 82 such that the rounded portion 86 rests against a rounded seating surface 100 of the slot 72.

Figure 5:
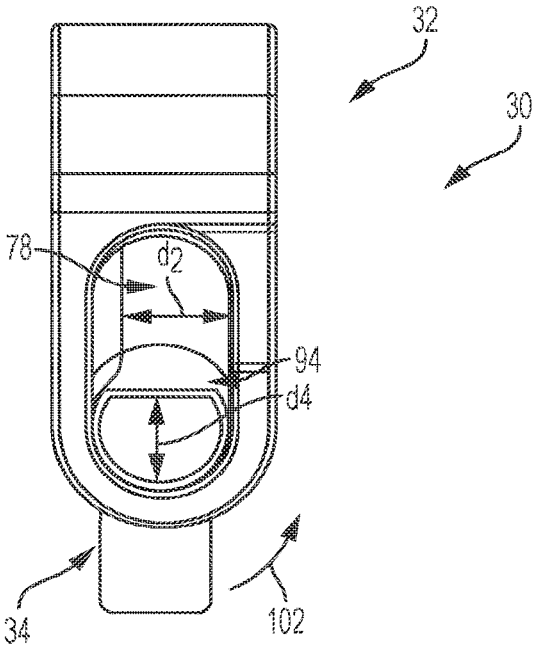
FIG. 5 illustrates a side view of the linkage assembly of FIG. 4 in an interlocked configuration according to one or more embodiments shown and described herein.
Figure 6:
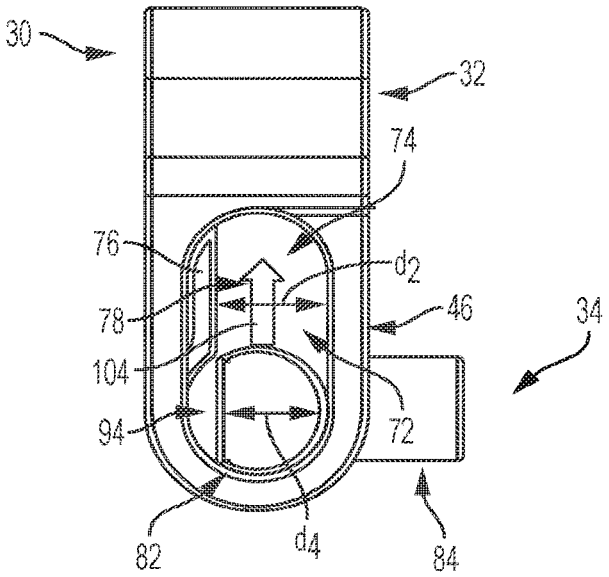
FIG. 6 illustrates a side view of the linkage assembly of FIG. 4 in a release configuration according to one or more embodiments shown and described herein.
Figure 7:
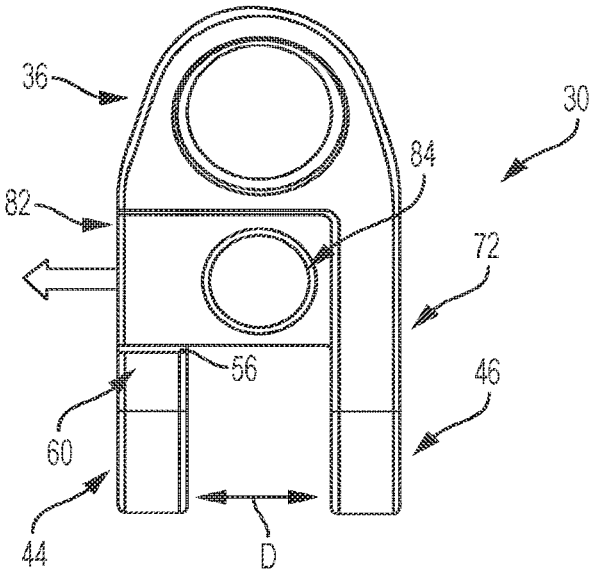
FIG. 7 is a front view of the linkage assembly of FIG. 4 in the release configuration according to one or more embodiments shown and described herein.

FIG. 5 illustrates the linkage assembly 30 in the interlocked orientation illustrating the region 78 of reduced dimension $d_2$ of the keyed slot 74 and the region 94 of reduced dimension $d_4$ of the interlocking portion 82 offset from the region 78 thereby positioning the interlocking member 34 in an interlocked orientation. To place the interlocking member 34 in a release orientation, the bar connecting portion 84 is rotated in the direction of arrow 102 (90 degrees in this embodiment) until the region 94 of reduced dimension $d_4$ is aligned with the region 78 of reduced dimension $d_2$ as shown by FIG. 6. In the release orientation, the dimension $d_4$ of the interlocking portion 82 is less than the dimension $d_2$ of the keyed slot 74 thereby allowing the interlocking portion 82 to slide vertically within the keyed slot 74 in the direction of arrow 104 along the vertical wall 76 as shown by FIG. 7. In this raised position, the bar connecting portion 84 is aligned with the gap 60 between the end 56 of the first connection leg 44 and the lift connecting portion 36 so that the interlocking portion 82 can slide out of the slot 72 and from the keyed slot 74. It should be appreciated that a distance D between the first connection leg 44 and the second connection leg 46 may be selected to interfere with side-to side movement of the bar connecting portion 84 so that end 92 of the interlocking portion 82 cannot be removed from the slot 72 with the interlocking member in the interlocked orientation as shown by FIGS. 4 and 5.

Figure 8:
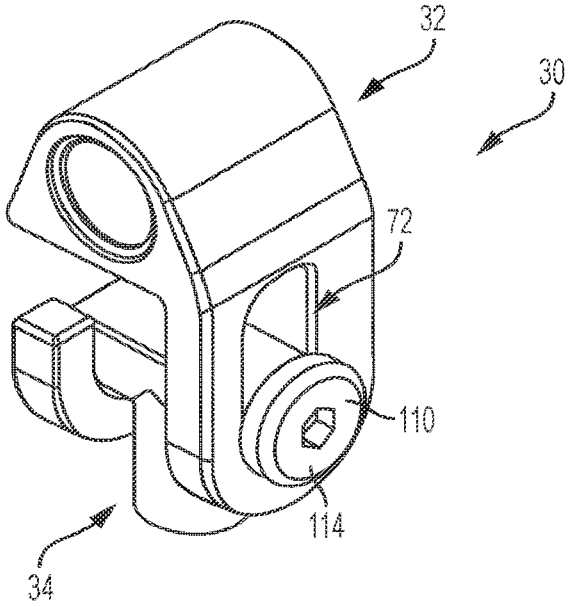
FIG. 8 is a perspective view of the linkage assembly of FIG. 4 in an interlocked configuration according to one or more embodiments shown and described herein.

Referring to FIG. 8, the linkage assembly 30 may have a locked configuration where a fastener 110 may be inserted within an opening 112 (FIG. 3) of the interlocking member 34. The fastener 110 may have a head portion 114 having a width that is greater than a width of the slot 72 so that the interlocking portion 82 cannot be removed from the slot 72, even with the interlocking member 34 in the release orientation.

Figure 9:
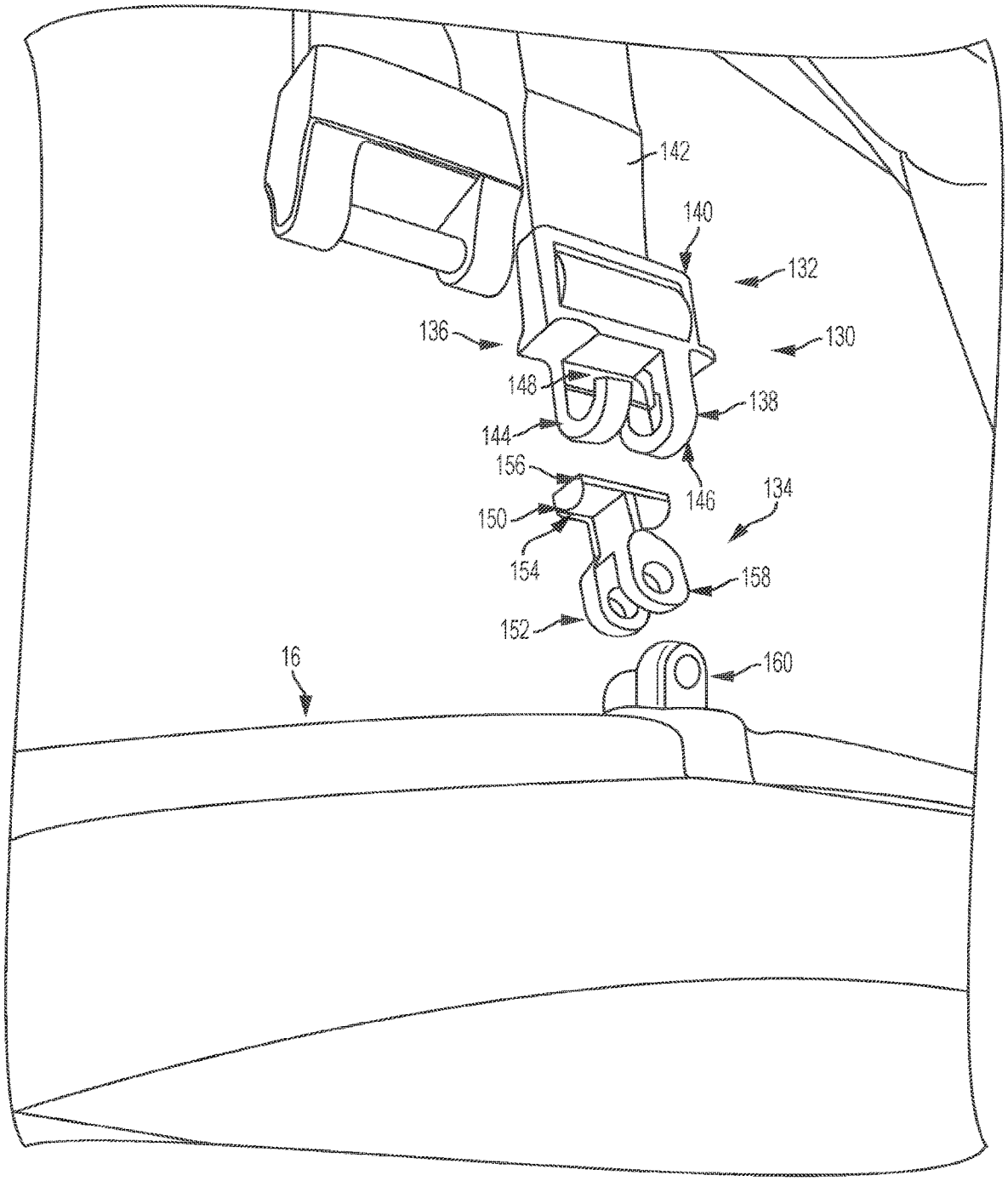
FIG. 9 illustrates another embodiment of a linkage assembly according to one or more embodiments shown and described herein.

Referring to FIG. 9, another embodiment of a linkage assembly 130 is illustrated that includes many of the features described above in regard to linkage assembly 30 including a link body 132 and interlocking member 134. As above, the link body 132 includes a lift connecting portion 136 and a sling bar connecting portion 138. The lift connecting portion 136 includes a connector 140, which, in this embodiment, is a buckle that can releasably couple with a support strap 142 of an overhead structure. The sling bar connecting portion 138 includes a first connection leg 144 and a second connection leg 146 that together form a keyed slot 148 in a fashion similar to that described above.

The interlocking member 134 includes an interlocking portion 150 and a bar connecting portion 152 that extends outward from the interlocking portion 150 forming a T-shape. As above, the interlocking portion 150 has a rounded portion 154 and a flat portion 156. In this example, the bar connecting portion 152 includes a connector 158 for connecting to a corresponding connector 160 on the sling bar 16.

In various embodiments, such as the embodiment depicted in FIG. 1, the subject support apparatus 12 is coupled to an overhead structure using a sling bar 200. FIG. 9 depicts a sling bar 200 in greater detail.

Figure 10:
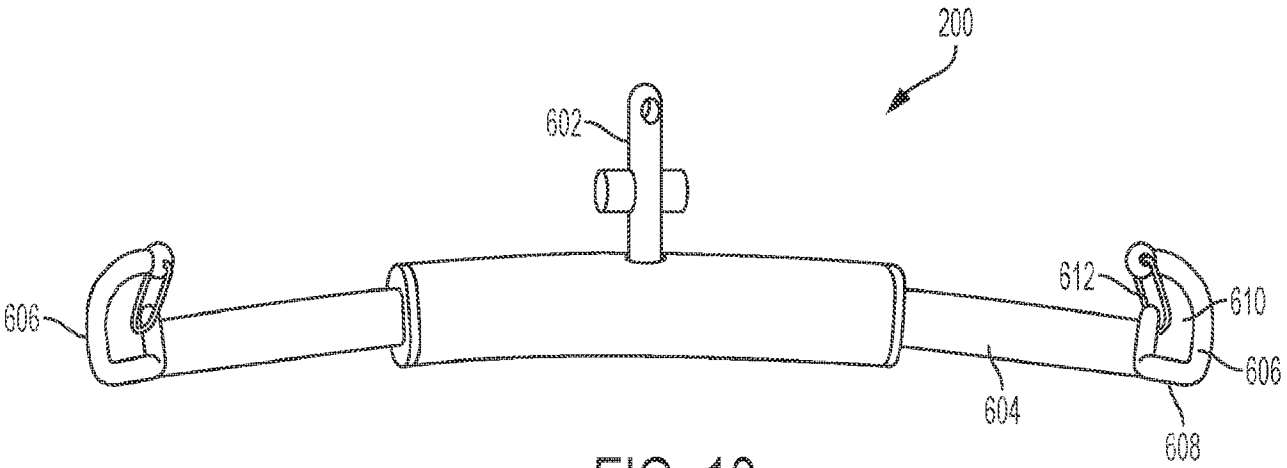
FIG. 10 illustrates a sling bar for use with the linkage assembly of FIG. 4 according to one or more embodiment shown and described herein.

As shown in FIG. 10, the sling bar 200 includes a connector 602 for coupling the sling bar 200 to an overhead structure, such as a lift assembly. The connector 602 is fixedly coupled to the sling bar 200 in FIG. 10, although in other embodiments, the connector 602 may be movably coupled to the sling bar 200. Without being bound by theory, allowing the connector 602 to move with respect to the sling bar 200 may help to decrease the torque forces on the connector 602 when a subject support apparatus is coupled to the sling bar 200, maintain the alignment of the subject support apparatus, sling bar, and overhead structure, and prevent twisting of various components.

The sling bar 200 includes an elongated bar 604 and two hooks 606 coupled to the distal ends of the elongated bar 604. In other embodiments, the sling bar 200 may be an X-shaped sling bar that includes two curved frame members coupled by a middle frame member and including four support apparatus coupling mechanisms. In still other embodiments, the sling bar may include a U-shaped frame including two support apparatus coupling mechanisms and a U-shaped handle extending from the frame to provide stability to a subject being lifted. Other sling bar configurations are contemplated. Various sling bar configurations are described in greater detail in U.S. Patent Application Publication No. 2015/0216753, entitled "Person Lift System", which is hereby incorporated by reference in its entirety.

The hooks 606 include a coupling base 608 with a recessed space 610 therein and a latch 612 configured to selectively enclose the recessed space 610. The latch 612 is pivotally coupled to the coupling base 608 and is configured to extend across the recessed space 610 in a closed position and rotate towards the recessed space 610 in an open position. In operation, when a user couples a subject support apparatus to the hook 606, the user pushes the latch 612 (i.e., rotates the latch 612 toward the recessed space 610), such as with a shoulder strap and/or a loop strap to allow the strap(s) or other portion of the subject support apparatus to be inserted into the recessed space 610. When a user removes the subject support apparatus from the hook 606, the user pushes the latch 612 to rotate the latch 612 toward an open position (i.e., rotates the latch 612 toward the recessed space 610) and allow the subject support apparatus to be removed from the recessed space 610.

Suitable sling bars include, by way of example and not limitation, those commercially available under the trade names Universal SlingBar, SlingBar Mini, and Sling Cross-Bar, from Liko, HILL-ROM®, or Hill-Rom Services, Inc. (Batesville, Ind.). Additionally, it is contemplated that some embodiments may not include a sling bar.

Figure 11:
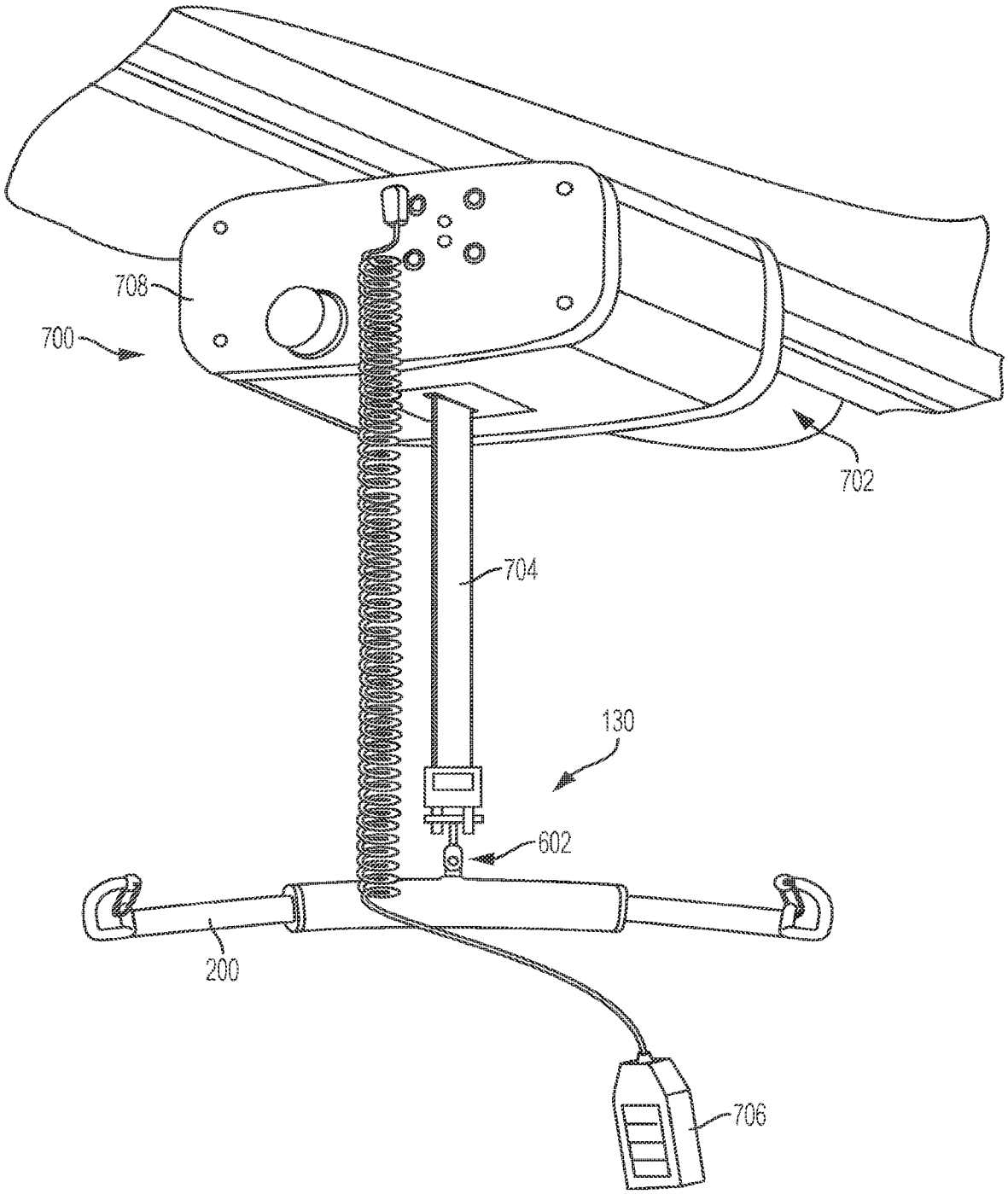
FIG. 11 illustrates a person lift apparatus according to one or more embodiments shown and described herein.

In some embodiments, an overhead structure may be a lift assembly, such as a mobile lift or an overhead lift assembly 700 as depicted in FIG. 11. The overhead lift assembly 700 may include a lift 702, a strap 704 (or other flexible member such as a rope) configured to be extended and retracted by the lift 702, and a control system including an input device 706 configured to control operations of the lift 702. In embodiments, the sling bar 200 is coupled to an end of the strap 704 through the connector 602 and the linkage assembly 30, 130. The lift 702 may further include a motor and a drum, each positioned within a housing 708. The drum may be coupled to a shaft of the motor and may be configured to extend and retract the strap 704 as the motor rotates the drum in response to a user providing an input to the control system via an input device 706. Various lift assemblies may be employed, including those described in U.S. Patent Application Publication No. 2015/0216753, entitled "Person Lift System", which is hereby incorporated by reference in its entirety. Suitable commercially available lift assemblies include, by way of example and not limitation, lift systems available under the trade names GOLVO®, LIKO®, SABINA®, VIKING®, UNO™, LIKOGUARD™, LIKO-RALL™, and MULTIRALL™, from Liko, HILL-ROM®, or Hill-Rom Services, Inc. (Batesville, Ind.).

While a lift assembly, such as the one shown and described in FIG. 11, may enable vertical lifting of the subject, in some embodiments, such as embodiments in which the subject is capable of standing or walking with support, the overhead structure 24 may provide support rather than vertical lifting. In such embodiments, the overhead structure 24 may be a ceiling. Alternatively or in addition, the overhead structure 24 may be another structure that is stationary in one or both vertical and horizontal directions relative to the ceiling. Without being bound by theory, embodiments in which the subject support apparatus is coupled to a stationary overhead structure may enable facilities that cannot afford to have a complete overhead system including an overhead lift motor and a track, or otherwise lack such systems, to provide support to subjects that need it. Accordingly, coupling the subject support apparatus to a stationary overhead structure may reduce budgetary concerns while enabling facilities to provide care to subjects that can support body weight.

Figure 12:
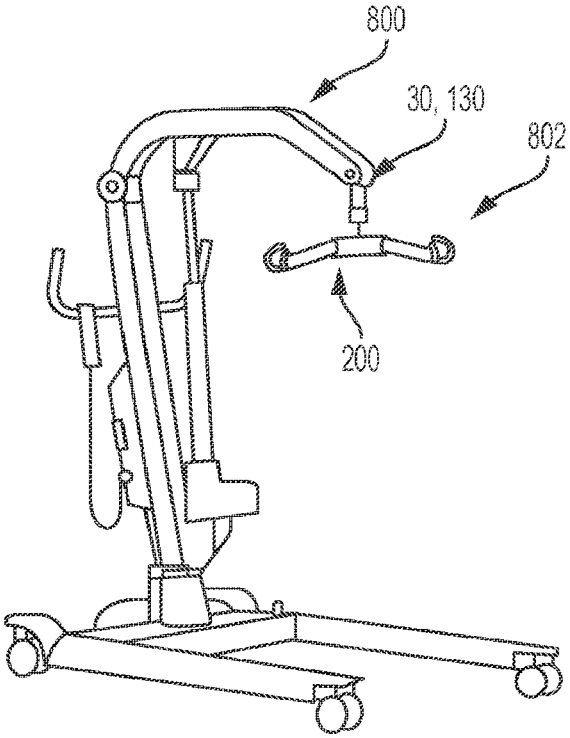
FIG. 12 illustrates another person lift apparatus according to one or more embodiments shown and described herein.

In some embodiments, an overhead structure 800 may be provided by a mobile lift assembly 802. An exemplary mobile lift assembly 802 is illustrated by FIG. 12. As above, the linkage assemblies 30, 130 may be used in connecting a sling bar to the mobile lift assembly 802.

Based on the foregoing, it should be understood that various embodiments provide for linkage assemblies that can be used to couple sling bars to a variety of person lift apparatuses. The linkage assemblies include a link body and an interlocking member that releasably couples to the link body. The link body can include a connector for connecting with a strap or other lifting member of the person lift apparatus. The interlocking member may also include a connector for connecting with the sling bar. The linkage assemblies include an interlocked configuration and a release configuration. An operator utilizes steps to place the interlocking member in a release orientation relative to the link body. In particular, the operator rotates the interlocking member relative to the link body to move the interlocking member from an interlocked configuration to the release configuration in which the interlocking member can be decoupled from the link body. This movement between the interlocked orientation to the release orientation demands some attention from the operator in order to both connect the link bar to and to release the link bar from the person lift apparatus.

Embodiments can be described with reference to the following numbered clauses, with preferred features laid out in the dependent clauses:

1. A linkage assembly that connects a sling bar to a person lift apparatus includes a link body that connects to the person lift apparatus. The link body has a keyed slot extending therethrough. The keyed slot has a region of reduced dimension. An interlocking member that connects to the sling bar. The interlocking member has an interlocking portion that is sized to be slidably received in the keyed slot. The interlocking portion has a region of reduced dimension such that, in an interlocked orientation, the region of reduced dimension of the interlocking portion is offset from the region of reduced dimension of the keyed slot thereby inhibiting removal of the interlocking member from the keyed slot and, in a release orientation, the region of reduced dimension of the interlocking portion is aligned with the region of reduced dimension of the keyed slot thereby allowing removal of the interlocking member from the keyed slot to disconnect the sling bar from the person lift apparatus.

2. The linkage assembly of the preceding clause, wherein the link body includes a lift connecting portion and a sling bar connecting portion. The lift connecting portion is configured to connect to the person lift apparatus. The sling bar connecting portion has the keyed slot.

3. The linkage assembly of the preceding clause, wherein the lift portion comprises a connector that connects to the person lift apparatus. The sling bar connecting portion includes a first connection leg that extends outwardly from an edge of the lift portion. A second connection leg extends outwardly from an opposite edge of the lift portion and is spaced from the first connection leg.

4. The linkage assembly of the preceding clause, wherein the first connection leg includes a first vertical portion that extends outwardly from the link body and a second vertical portion that is connected to the first vertical portion by a bend.

5. The linkage assembly of the preceding clause, wherein the second vertical portion terminates at an end that is spaced from the lift connecting portion forming a hook shape.

6. The linkage assembly of any of clauses 3-5, wherein the second connection leg includes a first vertical portion extending outwardly from the link body and a second vertical portion that is connected to the first vertical portion by a bend.

7. The linkage assembly of the preceding clause, wherein the second vertical portion being connected directly to the link body, the first vertical portion of the second connection leg being spaced from the second vertical portion of the second connection leg forming a slot therebetween, the slot being aligned with the hook shape of the first connection leg.

8. The linkage assembly of any of clauses 3-7, wherein the sling bar connecting portion includes a wall that extends between the first connection leg and the second connection leg. The wall has a widthwise dimension that provides the keyed slot with the region of reduced dimension.

9. The linkage assembly of any of clauses 3-8, wherein the interlocking member has a bar connecting portion that extends outwardly from the interlocking portion. The bar connecting portion is located between the first connection leg and the second connection leg with the interlocking member in the interlocked orientation.

10. The linkage assembly of any of the preceding claims, wherein the interlocking portion has a rounded portion and a flat portion forming a truncated cylinder that provides the interlocking member with the region of reduced dimension.

11. A person lifting apparatus including an overhead structure including a flexible member and linkage assembly of any of the preceding clauses that is connected to the flexible member.

12. The person lifting apparatus of the preceding clause further including a sling bar that is coupled to the linkage assembly.

13. The person lifting apparatus of the preceding clause, wherein the interlocking member has a bar connecting portion that extends outwardly from the interlocking portion, the bar connecting portion of the interlocking member coupled to the sling bar.

14. The person lifting apparatus of any of clauses 11-13, wherein the link body includes a lift connecting portion and a sling bar connecting portion. The lift connecting portion is connected to the flexible member. The sling bar connecting portion has the keyed slot.

15. The person lifting apparatus of the preceding clause, wherein the lift portion includes a connector that is connected to the flexible member. The sling bar connecting portion includes a first connection leg that extends outwardly from an edge of the lift portion. A second connection leg extends outwardly from an opposite edge of the lift portion and is spaced from the first connection leg.

16. The person lifting apparatus of the preceding clause, wherein the first connection leg includes a first vertical portion extending outwardly from the link body and a second vertical portion that is connected to the first vertical portion by a bend.

17. The person lifting apparatus of the preceding clause, wherein the second vertical portion terminates at an end that is spaced from the lift connecting portion forming a hook shape.

18. The person lifting apparatus of any of clauses 15-17, wherein the second connection leg includes a first vertical portion that extends outwardly from the link body and a second vertical portion that is connected to the first vertical portion by a bend.

19. The person lifting apparatus of the preceding clause, wherein the second vertical portion is connected directly to the link body. The first vertical portion of the second connection leg being spaced from the second vertical portion of the second connection leg forming a slot therebetween. The slot is aligned with the hook shape of the first connection leg.

20. The person lifting apparatus of any of clauses 15-19, wherein the sling bar connecting portion includes a wall that extends between the first connection leg and the second connection leg. The wall has a thickness dimension that provides the keyed slot with the region of reduced dimension.

21. The person lifting apparatus of any of clauses 15-19, wherein the interlocking member has a bar connecting portion that extends outwardly from the interlocking portion. The bar connecting portion is received between the first connection leg and the second connection leg with the interlocking member in the interlocked orientation.

22. The person lifting apparatus of any of clauses 11-21, wherein the interlocking portion has a rounded portion and a flat portion forming a truncated cylinder that provides the interlocking member with the region of reduced dimension.

23. A method of coupling a sling bar to a person lift apparatus using a linkage assembly of any of clauses 1-10 includes connecting a link body of the linkage assembly to the person lifting apparatus. The interlocking member is connected to the sling bar. The interlocking member is positioned in the release orientation and inserted into the keyed slot.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A linkage assembly that connects a sling bar to a person lift apparatus, comprising:

a link body that connects to the person lift apparatus, the link body having a keyed slot extending therethrough, the keyed slot having a region of reduced dimension; and an interlocking member that connects to the sling bar, the interlocking member having an interlocking portion sized to be slidably received in the keyed slot, the interlocking portion having a region of reduced dimension such that, in an interlocked orientation, the region of reduced dimension of the interlocking portion is offset from the region of reduced dimension of the keyed slot thereby inhibiting removal of the interlocking member from the keyed slot and, in a release orientation, the region of reduced dimension of the interlocking portion is aligned with the region of reduced dimension of the keyed slot thereby allowing removal of the interlocking member from the keyed slot to disconnect the sling bar from the person lift apparatus.

2. The linkage assembly of claim 1, wherein the link body includes a lift connecting portion and a sling bar connecting portion, the lift connecting portion configured to connect to the person lift apparatus, the sling bar connecting portion having the keyed slot.

3. The linkage assembly of claim 2, wherein the lift connecting portion comprises a connector that connects to the person lift apparatus and the sling bar connecting portion comprising:

a first connection leg that extends outwardly from an edge of the connecting lift portion; and a second connection leg that extends outwardly from an opposite edge of the lift connecting portion and spaced from the first connection leg.

4. The linkage assembly of claim 3, wherein the first connection leg includes a first vertical portion extending outwardly from the link body and a second vertical portion that is connected to the first vertical portion by a bend.

5. The linkage assembly of claim 4, wherein the second vertical portion terminates at an end that is spaced from the lift connecting portion forming a hook shape.

6. The linkage assembly of claim 5, wherein the second connection leg includes a first vertical portion extending outwardly from the link body and a second vertical portion that is connected to the first vertical portion by a bend.

7. The linkage assembly of claim 6, wherein the second vertical portion being connected directly to the link body, the first vertical portion of the second connection leg being spaced from the second vertical portion of the second connection leg forming a slot therebetween, the slot being aligned with the hook shape of the first connection leg.

8. The linkage assembly of claim 3, wherein the sling bar connecting portion includes a wall that extends between the first connection leg and the second connection leg, the wall having a widthwise dimension that provides the keyed slot with the region of reduced dimension.

9. The linkage assembly of claim 3, wherein the interlocking member having a bar connecting portion that extends outwardly from the interlocking portion, the bar connecting portion located between the first connection leg and the second connection leg with the interlocking member in the interlocked orientation.

10. The linkage assembly of claim 1, wherein the interlocking portion has a rounded portion and a flat portion forming a truncated cylinder that provides the interlocking member with the region of reduced dimension.

11. A person lift apparatus comprising:

an overhead structure comprising a flexible member; and a linkage assembly that is connected to the flexible member, the linkage assembly comprising:

a link body that having a keyed slot extending therethrough, the keyed slot having a region of reduced dimension; and an interlocking member that connects to the sling bar, the interlocking member having an interlocking portion sized to be slidably received in the keyed slot, the interlocking portion having a region of reduced dimension such that, in an interlocked orientation, the region of reduced dimension of the interlocking portion is offset from the region of reduced dimension of the keyed slot thereby inhibiting removal of the interlocking member from the keyed slot and, in a release orientation, the region of reduced dimension of the interlocking portion is aligned with the region of reduced dimension of the keyed slot thereby allowing removal of the interlocking member from the keyed slot to disconnect the sling bar from the person lift apparatus.

12. The person lifting apparatus of claim 11 further comprising a sling bar that is coupled to the linkage assembly.

13. The person lifting apparatus of claim 12, wherein the interlocking member has a bar connecting portion that extends outwardly from the interlocking portion, the bar connecting portion of the interlocking member coupled to the sling bar.

14. The person lifting apparatus of claim 11, wherein the link body includes a lift connecting portion and a sling bar connecting portion, the lift connecting portion connected to the flexible member, the sling bar connecting portion having the keyed slot.

15. The person lifting apparatus of claim 14, wherein the lift connecting portion comprises a connector connected to the flexible member and the sling bar connecting portion comprising:

a first connection leg that extends outwardly from an edge of the lift connecting portion; and a second connection leg that extends outwardly from an opposite edge of the lift connecting portion and spaced from the first connection leg.

16. The person lifting apparatus of claim 15, wherein the first connection leg includes a first vertical portion extending outwardly from the link body and a second vertical portion that is connected to the first vertical portion by a bend.

17. A method of coupling a sling bar to a person lift apparatus using a linkage assembly, the method comprising:

connecting a link body of the linkage assembly to the person lifting apparatus, the link body having a keyed slot extending therethrough, the keyed slot having a region of reduced dimension;

connecting an interlocking member to the sling bar the interlocking member having an interlocking portion sized to be slidably received in the keyed slot, the interlocking portion having a region of reduced dimension such that, in an interlocked orientation, the region of reduced dimension of the interlocking portion is offset from the region of reduced dimension of the keyed slot thereby inhibiting removal of the interlocking member from the keyed slot and, in a release orientation, the region of reduced dimension of the interlocking portion is aligned with the region of reduced dimension of the keyed slot thereby allowing removal of the interlocking member from the keyed slot to disconnect the sling bar from the person lift apparatus; and positioning the interlocking member in the release orientation and inserting the interlocking member into the keyed slot.

18. The method of claim 17, wherein the link body includes a lift connecting portion and a sling bar connecting portion, the lift connecting portion configured to connect to the person lift apparatus, the sling bar connecting portion having the keyed slot.

19. The method of claim 18, wherein the lift connecting portion comprises a connector that connects to the person lift apparatus and the sling bar connecting portion comprising:

a first connection leg that extends outwardly from an edge of the lift connecting portion; and a second connection leg that extends outwardly from an opposite edge of the lift connecting portion and spaced from the first connection leg.

20. The method of claim 19, wherein the first connection leg includes a first vertical portion extending outwardly from the link body and a second vertical portion that is connected to the first vertical portion by a bend, the second vertical portion terminates at an end that is spaced from the lift connecting portion forming a hook shape.

* * * * *